US009388637B2

(12) United States Patent
Ainge

(10) Patent No.: US 9,388,637 B2
(45) Date of Patent: Jul. 12, 2016

(54) UNDERGROUND REAMER

(75) Inventor: Stephen Ainge, Hornsby (AU)

(73) Assignee: HARD METALS AUSTRALIA PTY LIMITED, Eastern Creek, NSW (AU)

( * ) Notice: Subject to any disclaimer, the term of this patent is extended or adjusted under 35 U.S.C. 154(b) by 606 days.

(21) Appl. No.: 13/823,229

(22) PCT Filed: Sep. 15, 2011

(86) PCT No.: PCT/AU2011/001190

§ 371 (c)(1),
(2), (4) Date: May 28, 2013

(87) PCT Pub. No.: WO2012/037597

PCT Pub. Date: Mar. 29, 2012

(65) Prior Publication Data

US 2013/0248254 A1 Sep. 26, 2013

(30) Foreign Application Priority Data

Sep. 20, 2010 (AU) ..... 2010904234

(51) Int. Cl.
*E21B 10/28* (2006.01)
*B28D 1/14* (2006.01)
*E21B 7/30* (2006.01)

(52) U.S. Cl.
CPC ..... *E21B 10/28* (2013.01); *B28D 1/146* (2013.01); *E21B 7/30* (2013.01)

(58) Field of Classification Search
CPC ..... E21B 10/26; E21B 10/28; E21B 7/30; B28D 1/146
See application file for complete search history.

(56) References Cited

U.S. PATENT DOCUMENTS

| | | | | |
|---|---|---|---|---|
| 5,417,292 | A * | 5/1995 | Polakoff | E21B 10/26 175/335 |
| 6,131,675 | A | 10/2000 | Anderson | |
| 6,250,404 | B1 | 6/2001 | Gunsaulis | |
| 7,997,354 | B2 | 8/2011 | Radford et al. | |
| 2010/0175927 | A1 | 7/2010 | Zulak | |

FOREIGN PATENT DOCUMENTS

| | | |
|---|---|---|
| GB | 658510 | 10/1951 |
| GB | 774075 | 5/1957 |
| GB | 2341878 | 3/2000 |
| JP | 2001090464 | 4/2001 |
| WO | 2008070038 | 6/2008 |

OTHER PUBLICATIONS

International Search Report for PCT/AU2011/001190, Completed by the Australian Patent Office on Oct. 11, 2011, 3 Pages.

* cited by examiner

*Primary Examiner* — Brad Harcourt
(74) *Attorney, Agent, or Firm* — Brooks Kushman P.C.

(57) ABSTRACT

A reamer for underground passageways made, for instance, for the installation of cables or pipelines to distribute services in a reticulated network. It includes a support housing having plural integral pairs of spaced-apart laterally extending support wings, wherein between each pair of support wing there is a longitudinally extending slot to receive a laterally extending cutting wing such that each cutting wing is captured between a respective pair of support wings. A stabilization ring comprising a circular sleeve supported by plural radial support pillars which extend from a central collar. Wherein, the cutting wings engage with the support housing to resist rearward longitudinal movement, with the support wings to resist torsional forces, and with the circular sleeve of the stabilization ring to resist radial movement.

21 Claims, 10 Drawing Sheets

UNDERGROUND REAMER

CROSS-REFERENCE TO RELATED APPLICATION

This application is the U.S. national phase of PCT Appln. No. PCT/AU2011/001190filed on 15 Sep. 2011, which claims priority to Australian Patent Appln. No. 2010904234filed on 20 Sep. 2010, the disclosures of which are incorporated in their entirety by reference herein.

TECHNICAL FIELD

This invention concerns a reamer for underground passageways made, for instance, for the installation of cables or pipelines to distribute services in a reticulated network.

BACKGROUND ART

Smaller underground passageways for cables and pipes are generally created by first drilling a pilot hole with the use of a drill string. Once both the near and far ends of the pilot hole are open, a reamer is attached to the drill string, at either the near or far end. Then the reamer is forced along the length of the hole while spinning to enlarge it to the required diameter; depending on the size of the pipe or cable to be installed.

Several reamers of gradually increasing sizes may be used, depending on the required final diameter. A number of variations are possible, for instance the reamer can be pushed through the hole (forward reaming) or drawn backwards through (back reaming).

Referring now to FIG. 1 an existing underground reamer 10 is seen to comprise a cylindrical body 12 that in use is connected to the drill string. The cylindrical body has three laterally extending cutting wings 14 that are welded onto the cylindrical body or bolted into recesses 16 in the cylindrical body 12.

While travelling through the hole, for instance in the direction indicated by arrow 18 the reamer is rotated by the drill string in the clockwise direction (anticlockwise from behind as shown by arrow 20). It is the rotation of the wings that enlarges the hole.

The main problem with reamers with wings fixed by welding is they cannot be easily repaired on site. Satisfactory repairs can only be undertaken in a well equipped engineering workshop. This presents another difficulty in that it is extremely difficult to achieve the axial run out tolerances required in a fabrication process. As a later development, reamers with wings bolted into cylindrical body or inner shaft with fixed datums were expected to overcome these problems. However, what occurred with reamers of this kind was that, in use, the bolts 22 were placed under high torsional load and were able to work loose, causing the wings 14 to deflect. This type of deflection increases the diameter of the reamer and makes it susceptible to binding in the hole; which can lead to loss of the reamer and drill string; and sometimes abandonment of the hole. Another problem is that the reamer may not be well stabilised in the hole. This causes vibration which further exacerbates the binding problem.

As a result the wings 14 that are welded or bolted to the cylindrical body 12 often utilize a stabilizing ring 24 which is welded to the tips of the cutting wings 14. Welding the wings to a stabilizing ring has two functions:

- To join the cutting wings together to provide lateral stability to the wings.
- To smooth out the rotation of the reamer in the hole, reduce the incidence of vibration and provide stability.

This effectively makes them fixed wings and removes the facility to replace the cutting wings 14 in the field. Consequently, it requires them to be returned to a workshop to carry out repairs.

DISCLOSURE OF THE INVENTION

The invention is a reamer for underground passageways, comprising:

- A support housing having plural integral pairs of spaced-apart laterally extending support wings, wherein between each pair of support wing there is a longitudinally extending slot to receive a laterally extending cutting wing such that each cutting wing is captured between a respective pair of support wings.
- A stabilization ring comprising a circular sleeve supported by plural radial support pillars which extend from a central collar.
- Wherein, the cutting wings engage with the support housing to resist rearward longitudinal movement, with the support wings to resist torsional forces, and with the circular sleeve of the stabilization ring to resist radial movement.

The cutting wings may engage with the other components releasably to enable the wings to be replaceable in the field without the need to return the reamer to the workshop.

In addition, the cutting wings may engage with respective support pillars of the stabilization ring to resist relative rotation between them.

A plug may be used to connect the stabilization ring to the support housing and retain the circular sleeve in engagement with the cutting wings.

The plug may capture the central collar of the stabilization ring when it connects it to the support housing.

The engagement between the cutting wings and the support housing that resists rearward longitudinal movement may, in each case, comprise a flange extending from the wing that enters a recess in the bottom of the longitudinally extending slot.

The engagement between the cutting wings and the support wings that resists torsional forces may rely on a close fit between them and the use of bolts to interconnect the cutting wings with their respective support wings. For this purpose there may be bolt holes in the cutting wings that align with bolt holes in the support wings when the reamer is properly assembled. In one example there are four cutting wings fitted into four respective slots, and there are four pairs of support wings that are bolted to the cutting wings with two bolts each.

The engagement between the cutting wings and the circular sleeve of the stabilizing ring that resists radial movement may involve a step at the rear of each cutting wing that receives the front of the circular sleeve. In this way the circular sleeve overlies a rear flange of the cutting wings.

The engagement between the cutting wings and the support pillars may involve a flange in one entering a closed slot in the other.

There may be four pairs of support wings, four cutting wings and four support pillars.

Each of the support pillars of the stabilization ring may be penetrated by a bolt hole which aligns with a bolt hole in the support wings when the reamer is assembled, so that they can be bolted together.

The cutting wings may be sized for various diameters of passageway, and they may be shaped for forward reaming or back reaming depending on the requirement. They will generally have cutting edges that suit the terrain.

BRIEF DESCRIPTION OF THE DRAWINGS

An example of the prior art has been described with reference to FIG. 1 of the accompanying drawings, in which:

FIG. 1(*b*) is an elevation of the reamer of FIG. 1(*a*)

Figure 1B:
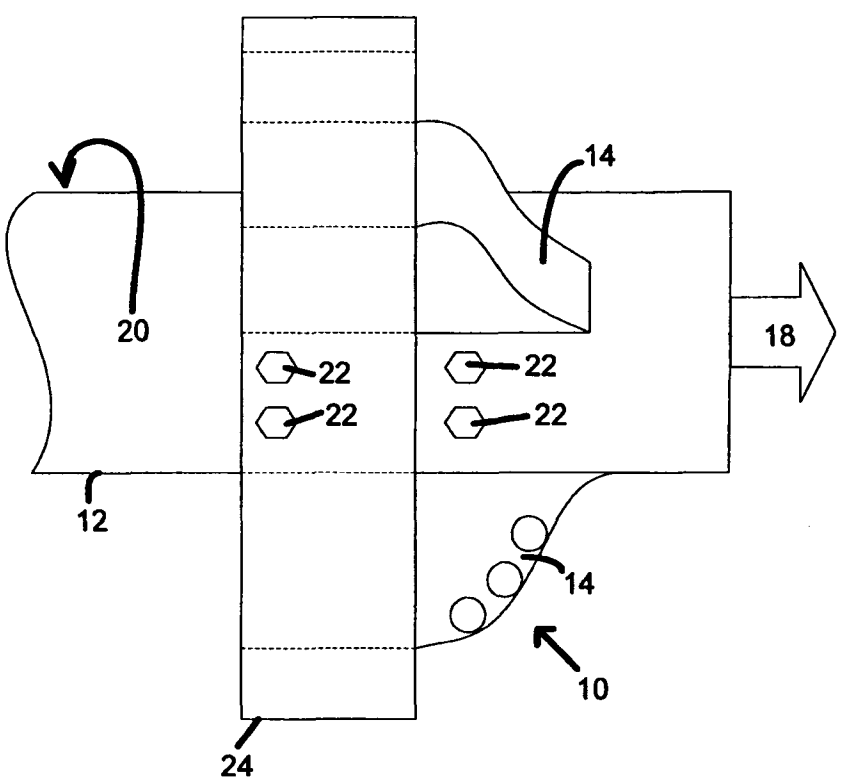
Fig. 1(b) Prior Art
FIG. 1(*a*) is a cross-section through the prior art reamer.
Figure 1A:
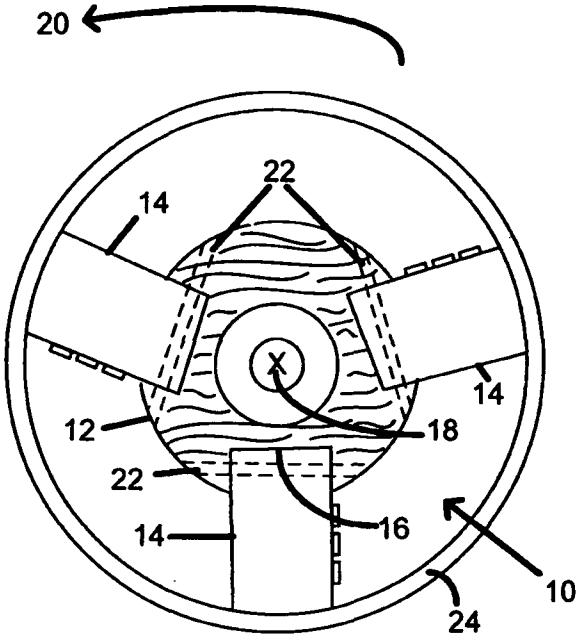
Fig. 1(a) Prior Art
Figure 2A:
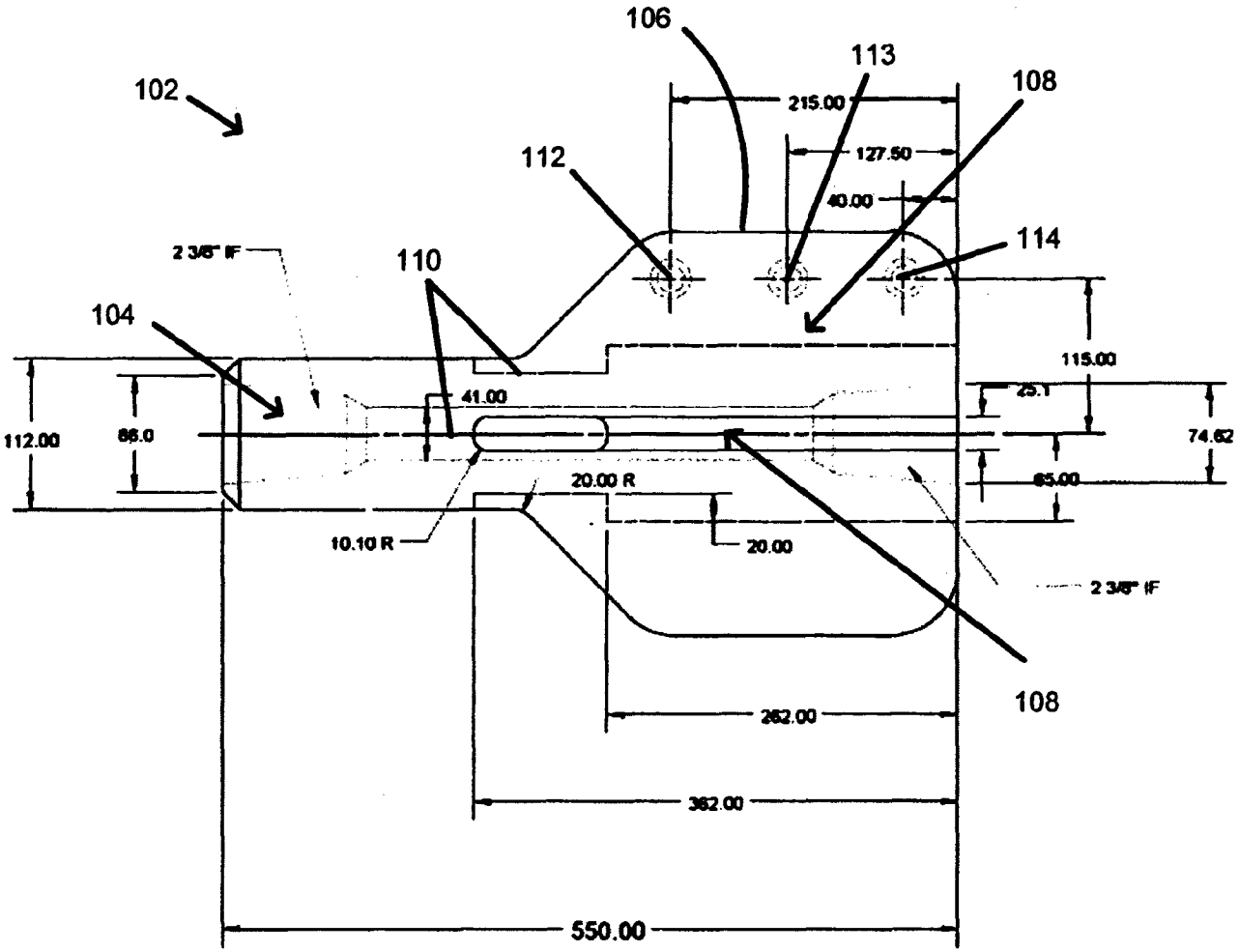
Figure 2B:
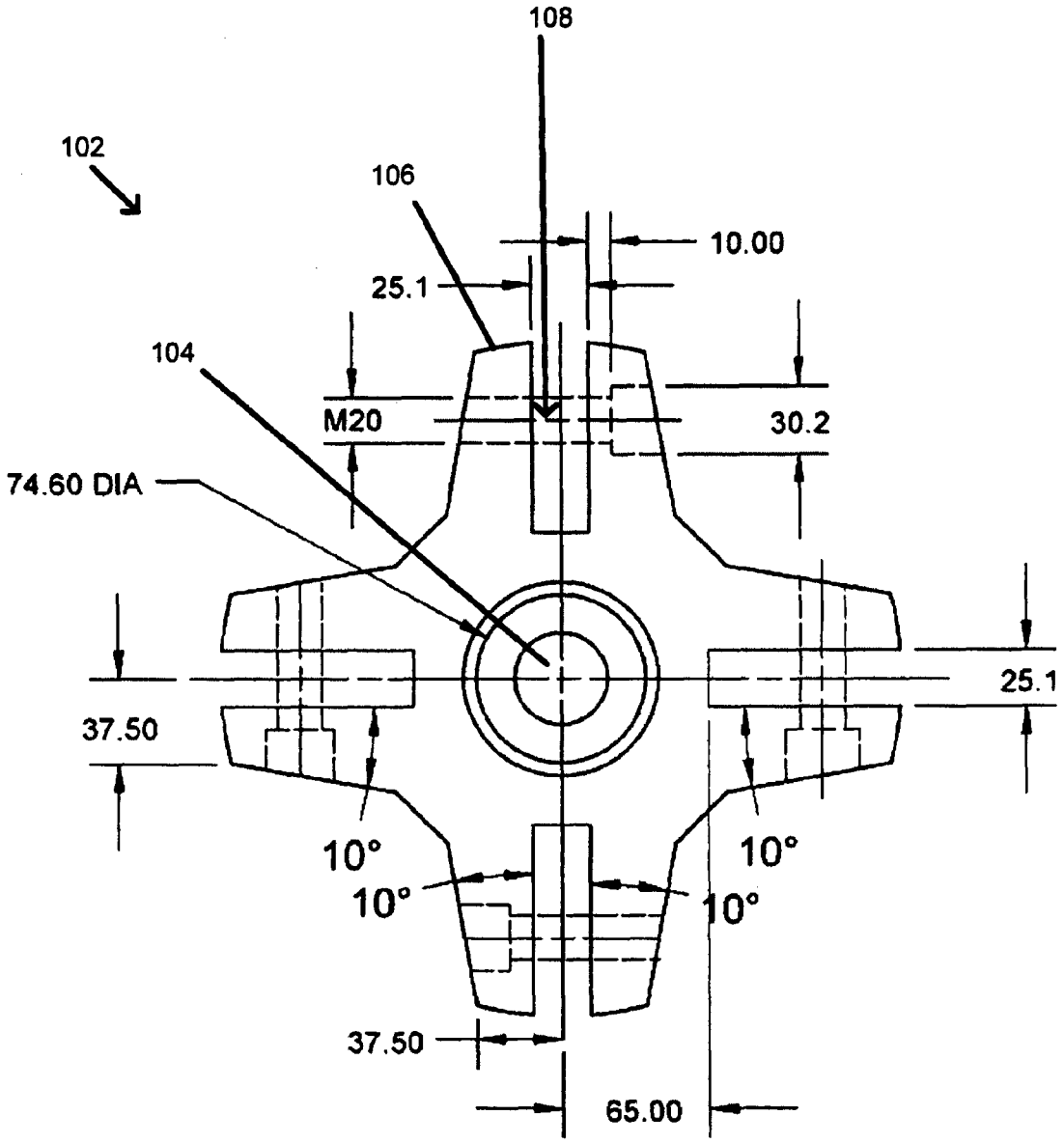

An example of the invention will now be described with reference to the following accompanying drawings, in which:

FIG. 2(*a*) is a simplified elevation of the support housing, showing only the side faces of two of the support wings.

FIG. 2(*b*) is a rear view of the support housing.

Figure 3A:
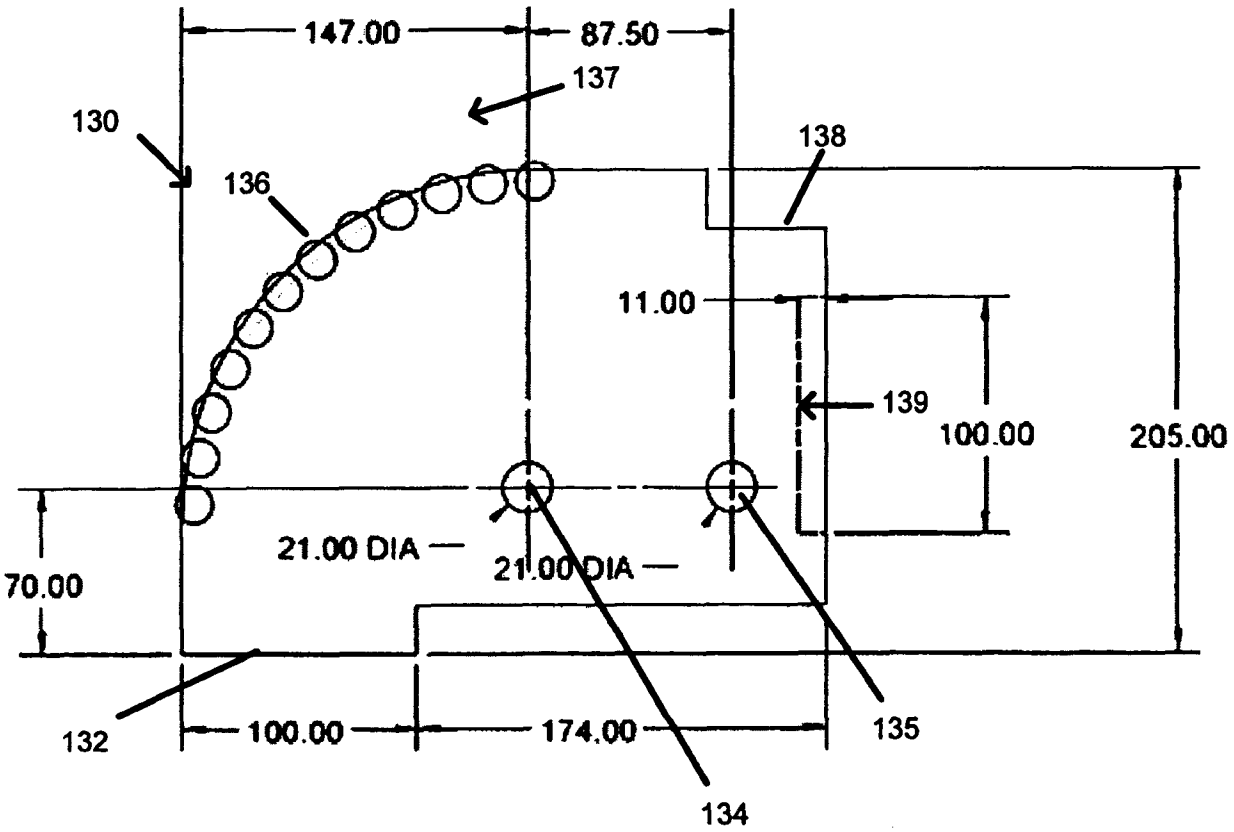
Figure 3B:
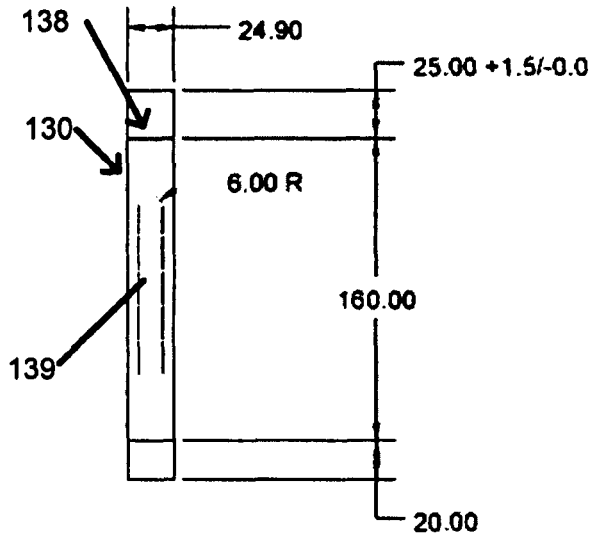
Figure 3C:
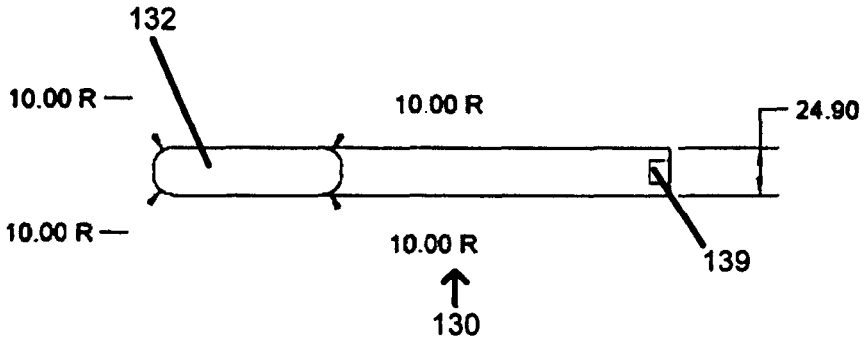

FIG. 3(*a*) is a side elevation of a cutter wing.

FIG. 3(*b*) is a rear elevation of a cutter wing.

FIG. 3(*c*) is the underside of a cutter wing.

Figure 4A:
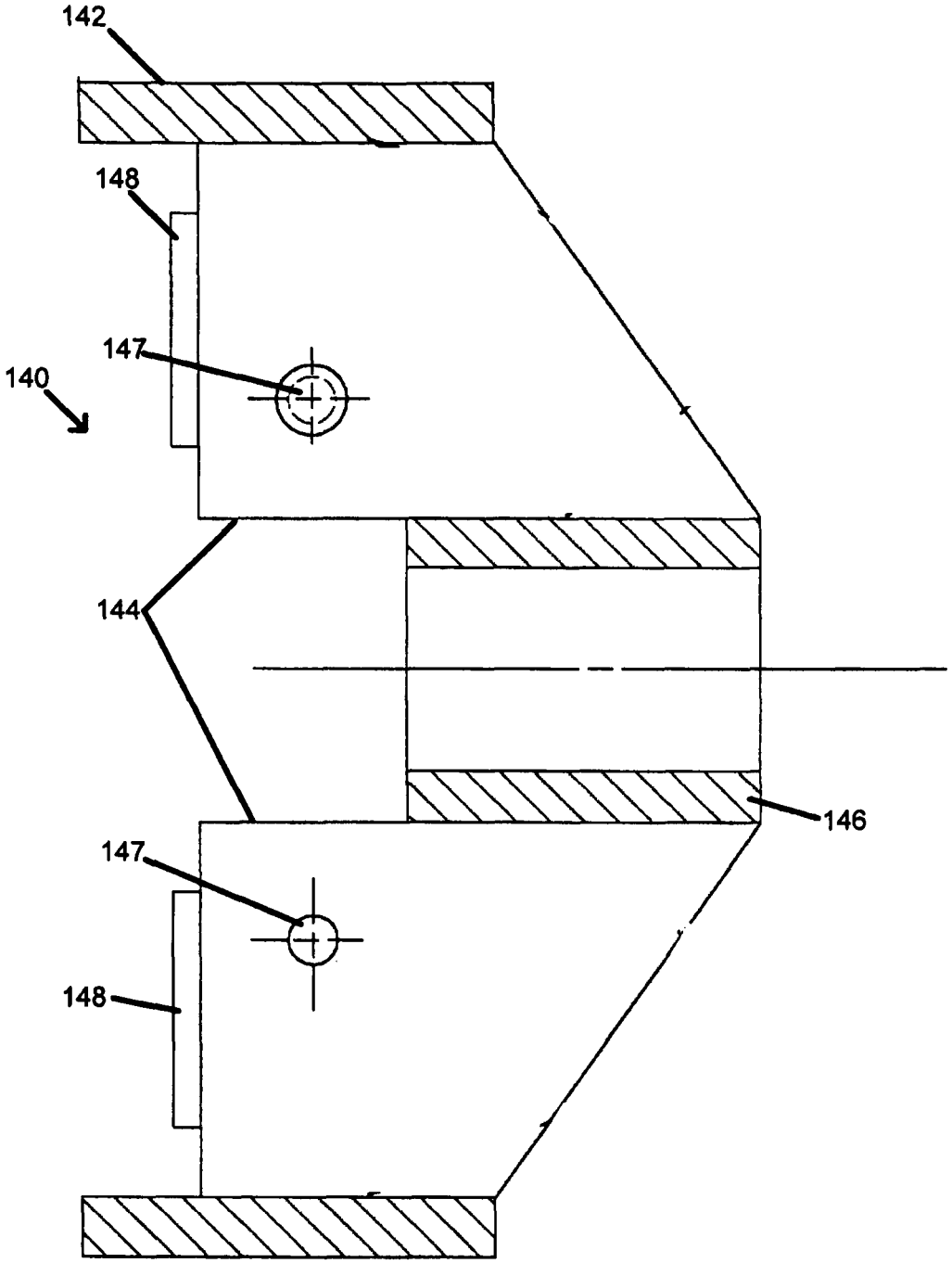
Figure 4B:
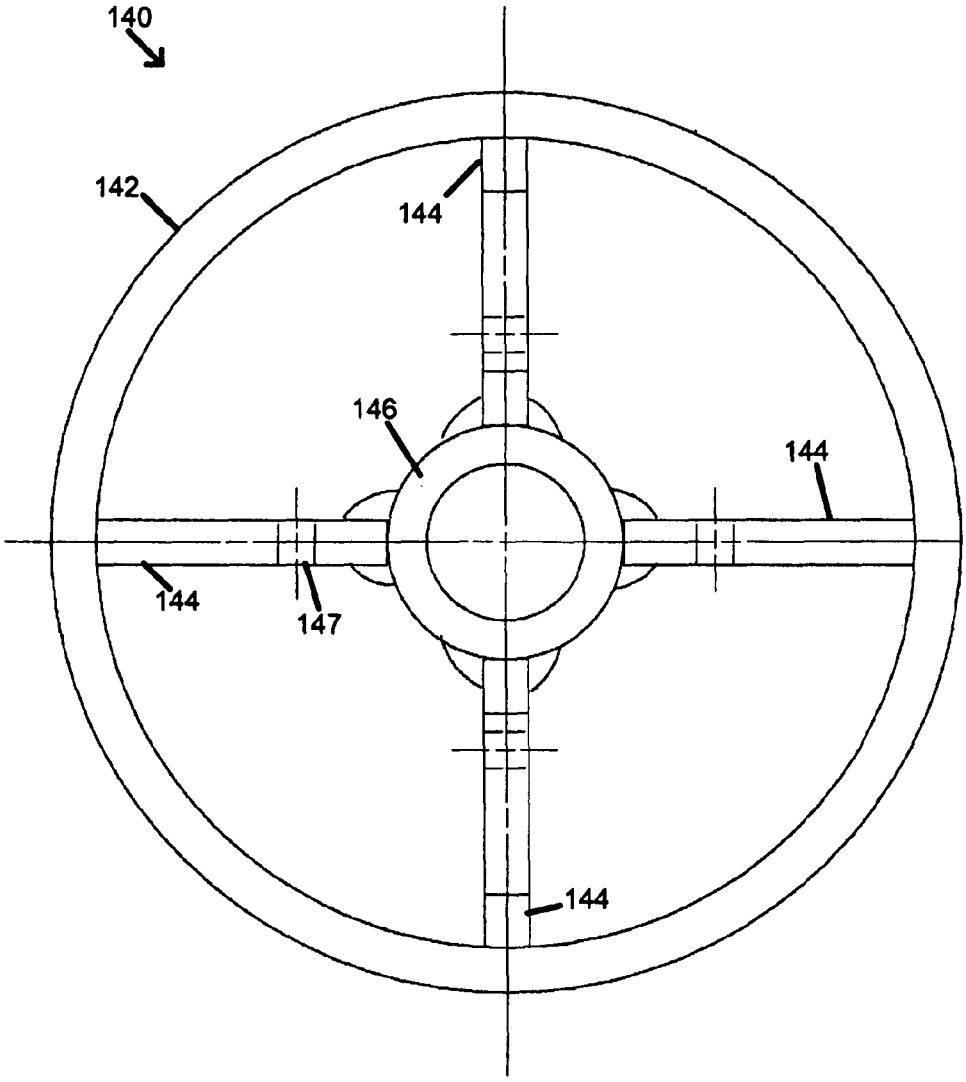

FIG. 4(*a*) is a cross-section of the stabilization ring and its support structure.

FIG. 4(*b*) is a rear elevation of the stabilization ring and its support structure.

Figure 5:
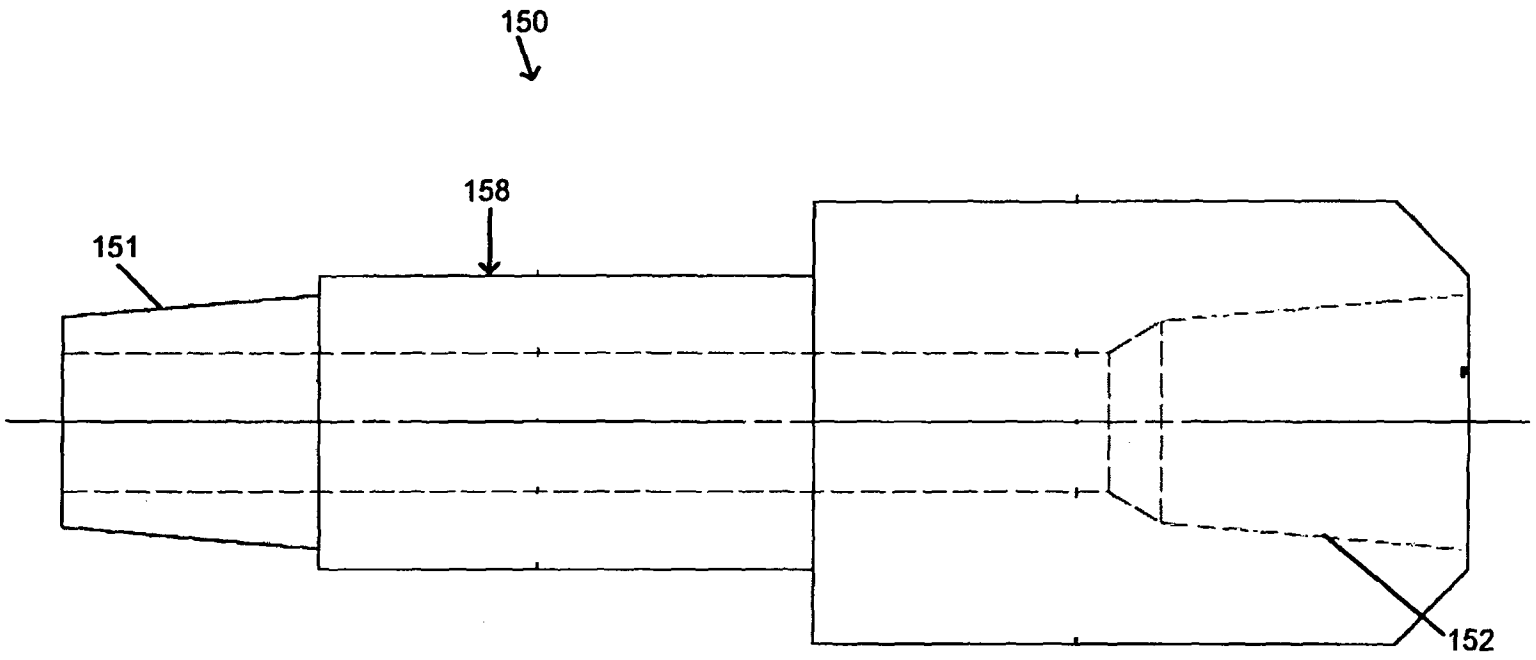

FIG. 5 is an elevation of the core of a reamer.

Figure 6A:
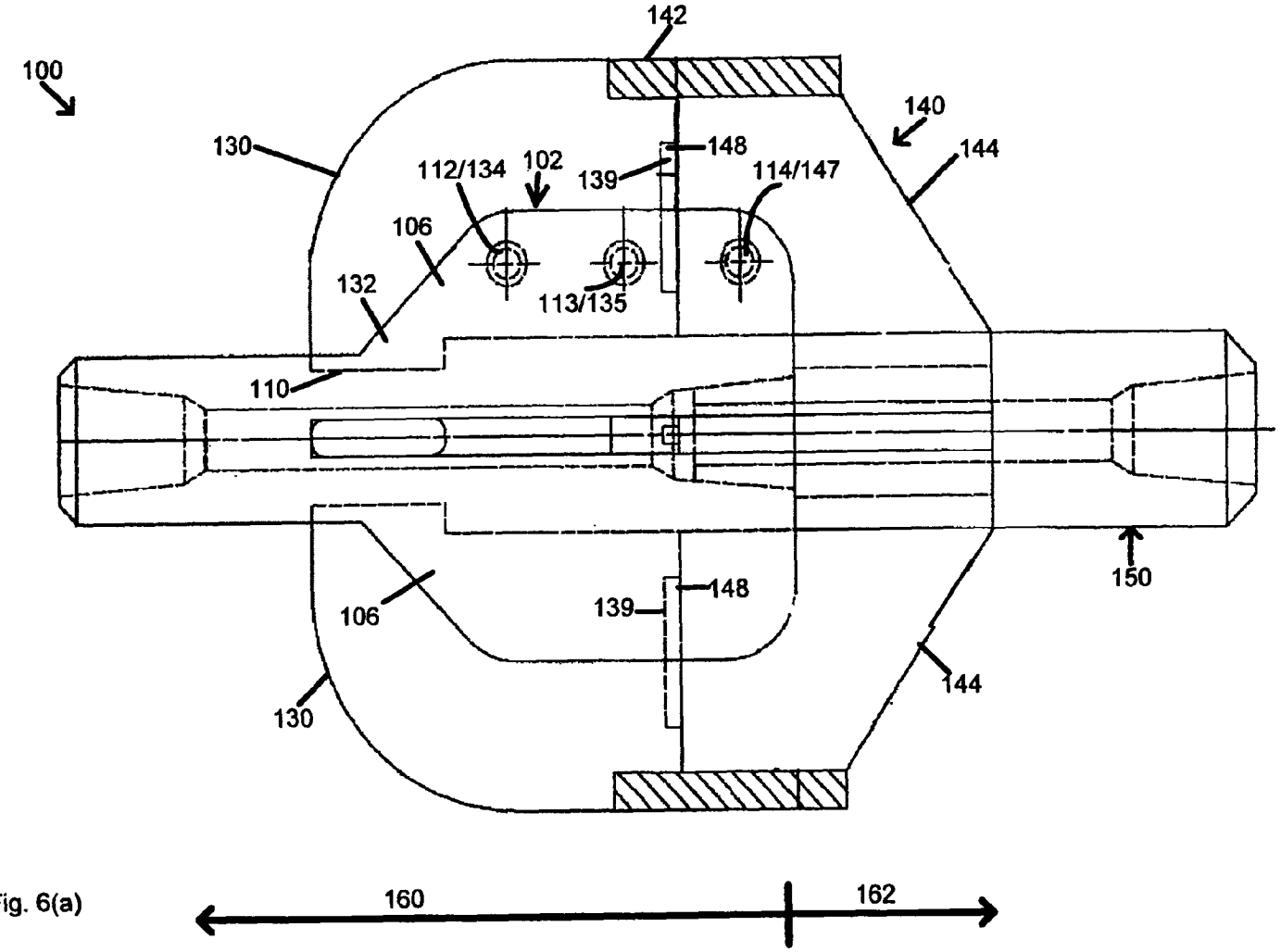
Figure 6B:
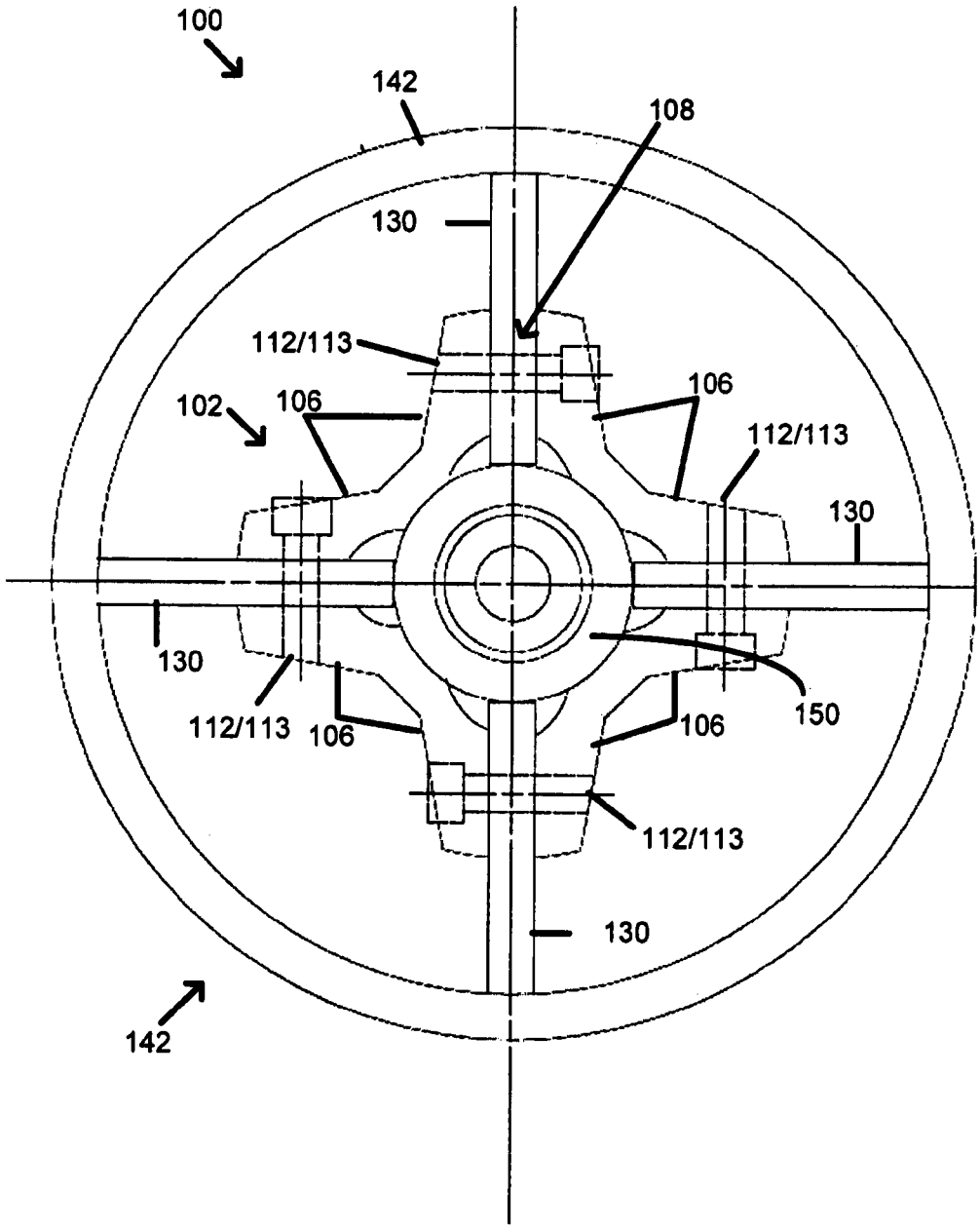

FIG. 6(*a*) is a simplified elevation of the assembled reamer, showing only the side faces of two of the support wings.

FIG. 6(*b*) is a rear view of the assembled reamer.

BEST MODES OF THE INVENTION

Referring now to FIG. 2 the support housing 102 of the underground reamer (see FIG. 6 for the assembled reamer 100) is seen to comprise a cylindrical steel body surrounding a hollow core 104. In use the drill string passes through it and is connected to it by formations 105 at the forward end. The support housing itself comprises four pairs of integrally cast or machined laterally extending steel support wings 106, with an open slot 108 between each pair of support wings 106. There is a recess 110 at the forward end of each open slot 108 sized to receive a tight fitting flange 132 of a cutting wing; (see FIG. 3 for the cutting wing). The support wings 106 are each penetrated by three bolt holes 112, 113 and 114. At the rear of the support housing 102 there are formations 109 for connection to a plug (see FIG. 5 for the plug 150).

Referring now to FIG. 3, each cutting wing 130 is seen to be equipped with a downwardly extending flange 132 for engagement with open slot 108 of the support housing 102. Also, each cutting wing has two bolt holes 134 and 135. Cutting inserts 136 are arranged along the leading curved surface 137. Also, there is a rearward extending flange 138 which is penetrated by a closed slot 139.

Referring now to FIG. 4, a stabilization ring 140 comprises a circular sleeve 142 supported by four support pillars 144 which extend from a collar 146. The entire stabilization ring structure is integrated into one piece by welding the component parts to each other. Each of the support pillars 144 are penetrated by a bolt hole 147, and each has a forwardly extending flange 148 sized to fit tightly into closed slot 139 of respective cutting wings 130.

Referring now to FIG. 5, hollow plug, or shaft, 150 has formations 151 designed to make a threaded engagement with the formations 109 at the rear of support housing 102. The plug is hollow so that the drilling fluid can pass through it, and be connected to it by formations 152 at the rear end. The formation 152 can be used to connect a driving drill rod when forward reaming or a towing eye when back reaming. The plateau 158 is sized to fit neatly into the collar 146 of stabilization ring 140, The assembled reamer will now be described with reference to FIG. 6. Before use the four cutting wings 130 are inserted into respective slots 108 between the pairs of support wings 106. The cutting wings 130 are moved down until the flange 132 is fully inserted into recess 110 in the support housing 102. The cutting wings 130 are then bolted to the adjacent pair of support wings 106; with two bolts passing respectively through the holes 112 and 113 in the support wings 106 and holes 134 and 135 in the cutting wings 130. This assembly forms the forward part 160 of the reamer 100.

The next step is to mount the stabilization ring 140 onto the rear of the forward part 160 of the reamer 100. To do so the support pillars 144 are aligned with the cutting wings 130 and slid into the slots 108 from the rear. The stabilization ring 140 is moved forward until the flanges 148 enter the slots 139 in the respective cutting wings 130. This engagement resists any rotation of the stabilization ring 140 relative to the reamer as a result of torsion forces during use. Also, in this position the forward part of the circular sleeve 142 overlies the step at the top of flange 138 extending rearward from the back of the cutting wings 130. In this way the circular sleeve 142 contains the rear flange 138 of the cutting wings and resists radial movement of them. Once the stabilization ring is properly mounted it is bolted onto the reamer by bolts that pass through holes 114 in the support wings 106, and holes 147 in the support pillars 144.

Finally, the plug 150 is inserted through collar 146 in the stabilization ring and connected to the hollow core of the support housing 102. The collar 146 is firmly supported to the support housing 102 by the plug 150.

In use, while travelling through the hole, for instance in the direction indicated by arrow 400 the reamer is rotated by the drill string in the clockwise direction (anticlockwise from behind as shown by arrow 420). It is the rotation of the cutting wings 130 that enlarges the hole. The forces applied to the cutting wings 130 are transmitted to the support wings 106, and are not absorbed by the bolts which secure the cutting wings 130 and support wings 106 to each other. Overall there is much more metal supporting the cutting wings than in the prior art arrangement described above. The result of this arrangement is that the bolts are not stressed and do not come loose. As an added measure of security, lock nuts are applied to the main bolts to minimise any chance of them coming loose.

The central core of the drill string, and reamer is hollow, and typically a lubricant 'mud' is pumped into this core to escape out of the reamer and flush the new cut debris from the hole.

The cutting inserts 136 fitted to the leading face of the cutting wings 130 wear away during use and require periodic replacement. To replace the cutting wings 130 the assembly process is reversed and new wings installed before reassembly. Since the cutting wings can be simply unbolted from the reamer, they are able to be replaced in the field when the cutting inserts are worn. The old cutting wings can then be sent back to the workshop for refurbishment.

Although the invention has been described with reference to a particular example, it will be appreciated by the appropriately skilled person that many modifications and additions are possible. For instance, the reamer may be reversible with cutting surfaces along both the forward and rearward facing edges of the cutting wings.

The invention claimed is:

1. A reamer for underground passageways, comprising:

a support housing having plural integral pairs of spaced-apart laterally extending support wings, wherein between each pair of support wings there is a longitudinally extending slot to receive a laterally extending cutting wing such that each cutting wing is captured between a respective pair of support wings; and a stabilization ring comprising a circular sleeve supported by plural radial support pillars which extend from a central collar;

wherein, the cutting wings engage with the support housing to resist rearward longitudinal movement, with the support wings to resist torsional forces, and with the circular sleeve of the stabilization ring to resist radial movement.

2. A reamer according to claim 1, wherein the cutting wings are releasably engagable with the support housing, the support wings, and the stabilization ring to enable the cutting wings to be replaceable in the field without returning the reamer to a workshop.

3. A reamer according to claim 1, wherein in addition, the cutting wings engage with respective support pillars of the stabilization ring to resist relative rotation between them.

4. A reamer according to claim 3, wherein engagement between the cutting wings and the support pillars involves a flange in one entering a closed slot in the other.

5. A reamer according to claim 1, wherein engagement between the cutting wings and the support housing comprises a flange extending from the cutting wing that enters a recess to a bottom of the longitudinally extending slot.

6. A reamer according to claim 1, wherein engagement between the cutting wings and the support wings relies on a close fit between them and further comprising bolts to interconnect the cutting wings with their respective support wings.

7. A reamer according to claim 6, wherein there are bolt holes in the cutting wings that align with corresponding bolt holes in the support wings to receive the bolts when the reamer is properly assembled.

8. A reamer according to claim 7, wherein there are four cutting wings fitted into four respective slots, and there are four pairs of support wings that are bolted to the cutting wings with two bolts each.

9. A reamer according to claim 1, wherein engagement between the cutting wings and the circular sleeve of the stabilizing ring involves a step at a rear of each cutting wing that receives a front of the circular sleeve.

10. A reamer according to claim 9, wherein the circular sleeve overlies a rear flange of the cutting wings.

11. A reamer according to claim 1, wherein the engagement between the cutting wings and the support pillars involves a flange in one entering a closed slot in the other.

12. A reamer according to claim 1, wherein there are four pairs of support wings, four cutting wings and four support pillars.

13. A reamer according to claim 1, wherein there is a bolt hole in each of the support pillars of the stabilization ring that aligns with a corresponding bolt hole in the support wings when the reamer is assembled, so that the support pillars and the support wings can be bolted together.

14. A reamer according to claim 1, wherein the cutting wings are sized for various diameters of passageway, and shaped for forward reaming or back reaming.

15. A reamer according to claim 14, wherein the cutting wings have cutting edges that suit a terrain to be reamed.

16. A reamer according to claim 1 wherein at least part of the support pillars are received in the longitudinally extending slots when the reamer is assembled.

17. A reamer for underground passageways, comprising:

a support housing having plural integral pairs of spaced-apart laterally extending support wings, wherein between each pair of support wings there is a longitudinally extending slot to receive a laterally extending cutting wing such that each cutting wing is captured between a respective pair of support wings;

a stabilization ring comprising a circular sleeve supported by plural radial support pillars which extend from a central collar; and a plug connecting the central collar of the stabilization ring to the support housing and retain the circular sleeve in engagement with the cutting wings;

wherein, the cutting wings engage with the support housing to resist rearward longitudinal movement, with the support wings to resist torsional forces, and with the circular sleeve of the stabilization ring to resist radial movement.

18. A reamer according to claim 17, wherein the plug captures the central collar of the stabilization ring when it connects it to the support housing.

19. A cutting wing for use in a reamer for underground passageways, the reamer having a stabilization ring and a support housing with plural integral pairs of laterally extending support wings each forming a longitudinally extending slot for receiving a laterally extending cutting wing, wherein the cutting wing comprises:

a first flange for engagement with a recess of the support housing; and a second flange for engagement with a circular sleeve of the stabilization ring, such that in use, the first flange of the cutting wing engages the recess to resist rearward longitudinal movement of the cutting wing relative to the support housing, the cutting wing engages a respective pair of support wings to resist torsional forces of the cutting wing relative to the support housing, and the second flange engages the circular sleeve of the stabilization ring to resist radial movement of the reamer in the underground passageway.

20. A cutting wing according to claim 19 wherein the second flange extends substantially perpendicular to the first flange, and the second flange further comprises:

a step at the second flange for engagement with a front of the circular sleeve; and a closed slot for receiving a forwardly extending flange of the stabilization ring such that in use, the cutting wing engages the stabilization ring to resist relative rotation between them.

21. A cutting wing according to claim 19 wherein the cutting wing further comprises:

one or more bolt holes for receiving bolts to interconnect the cutting wing and the respective support wings; and a leading curved surface with a plurality of cutting inserts.

* * * * *